United States Patent [19]

Reeves

[11] 4,063,152

[45] Dec. 13, 1977

[54] METHOD AND APPARATUS FOR TIMING LIGHT CALIBRATION

[75] Inventor: George I. Reeves, Fullerton, Calif.

[73] Assignee: Beckman Instruments, Inc., Fullerton, Calif.

[21] Appl. No.: 707,919

[22] Filed: Aug. 16, 1976

[51] Int. Cl.[2] ..... F02P 17/00

[52] U.S. Cl. ..... 324/16 T; 324/15; 324/16 S

[58] Field of Search ..... 324/16 T, 16 R, 16 S, 324/15, 130; 73/1 E, 5

[56] References Cited

U.S. PATENT DOCUMENTS

| | | | |
|---|---|---|---|
| 3,364,418 | 1/1968 | MacCrea | 324/16 T |
| 3,573,609 | 4/1971 | Vaher | 324/16 T |
| 3,697,865 | 10/1972 | Smith et al. | 324/16 T |
| 3,727,124 | 4/1973 | Kahen | 324/16 T |
| 3,781,656 | 12/1973 | Glew | 324/16 T |

FOREIGN PATENT DOCUMENTS

| | | | |
|---|---|---|---|
| 1,014,390 | 8/1957 | Germany | 324/16 T |
| 1,159,473 | 7/1969 | United Kingdom | 324/16 T |

*Primary Examiner*—Stanley T. Krawczewicz
*Attorney, Agent, or Firm*—Robert J. Steinmeyer; Paul R. Harder; Donald A. Streck

[57] ABSTRACT

Method and apparatus is disclosed for calibrating a timing light used in conjunction with an engine scope tester. The timing light is fired by an offset circuit in an engine scope tester having a meter indicating the offset amount. The engine scope tester is synchronized to the firing of a simulated No. 1 cylinder spark plug. The light from the timing light is detected by a phototransistor connected to a voltage reference source which amplifies the signal from the phototransistor to a usable level. The output of the voltage reference source is connected back to a vertical deflection circuit of the oscilloscope on the engine scope tester. The calibration marks on the oscilloscope of the engine scope tester are used to calibrate the meter on the engine scope tester indicating the offset to the timing light.

9 Claims, 7 Drawing Figures

TIMING LIGHT PULSE - NORMAL ADVANCE

TIMING LIGHT PULSE SET AT 15° ADVANCE

TIMING LIGHT PULSE - NORMAL RETARD

TIMING LIGHT PULSE SET AT 15° RETARD

METHOD AND APPARATUS FOR TIMING LIGHT CALIBRATION

BACKGROUND OF THE INVENTION

The present invention relates to methods and apparatus for engine testing in the automotive industry, and more particularly, to timing lights used in conjunction with engine scope testers.

Engine scope testers are being used more and more for the repair and maintenance of automotive engines. Such devices provide a capability for engine analysis and ignition adjustment far in excess of that possible without their use. In particular, the setting of the distributor position to provide spark plug firings at the correct point relative to engine rotation as specified by the manufacturers can be done in an accurate and positive manner with ease. In most automotive engines, a mechanical means is provided in conjunction with the revolving crank shaft to provide a single indication for ignition timing purposes. Typically, when a fixed mark on a rotating member is directly under a fixed pointer on the engine block, the No. 1 piston is at top dead center (TDC). In a rotary engine, an analogous provision is made. With only one fixed point of reference being made available, it is difficult to set the distributor to accurately fire at 7½° before TDC or 3° after TDC. In a modern engine scope tester, a lead is provided which is connected to the engine ignition system to sense the firing of the No. 1 spark plug. A timing light connected to the engine scope tester is coupled through an adjustable offset circuit so that the light can be fired before or after the actual firing of the No. 1 spark plug. The engine scope tester contains a meter indicating in distributor degrees the amount of this offset. The reading on the meter is twice that of the engine offset since the spark plugs fire once for every two engine revolutions and, consequently, the distributor rotates once for every two engine revolutions. Thus, if the manufacturer specifies a 10° offset for spark plug firing, a 5° distributor offset must be made. In such a case, the offset to the timing light is adjusted until the required offset is shown on the meter of the engine scope tester. With the engine running, the distributor is rotated to change the point at which the spark plugs fire. When the strobing timing light illuminates the fixed mark on the rotating member of the engine in alignment with the fixed pointer, the desired offset of 10° has been attained accurately and the distributor is secured in that position. Appropriate means are included in a typical engine scope tester for providing both advance and retard adjustments through this timing light offset technique. The technique for accomplishing the offset forms no part of the present invention. The present invention relates only to the apparatus and technique for accurately calibrating the meter on the engine scope tester to the actual offset being set into the timing light as displayed in distributor degrees.

SUMMARY

In the present invention, the signal to the timing light to fire is also directed so as to cause a vertical deflection on the sweeping CRT display of the engine scope tester. In the preferred embodiment, this is accomplished by sensing the light from the timing light with a photoelectric device such as a phototransistor. The electrical signal from the photoelectric device is then amplified and connected to a vertical deflection circuit of the CRT. In an alternate embodiment, a parallel physical connection is provided between the timing light signal source and the deflection circuit. To calibrate the timing light, zero offset is first selected and the deflection position on the CRT noted. An offset is then selected. The amount of offset is accurately determined by the change in deflection position on the calibrated scale of the CRT. The timing light offset indication meter is then adjusted to correctly display the offset selected.

DESCRIPTION OF THE PREFERRED EMBODIMENT

Figure 1:
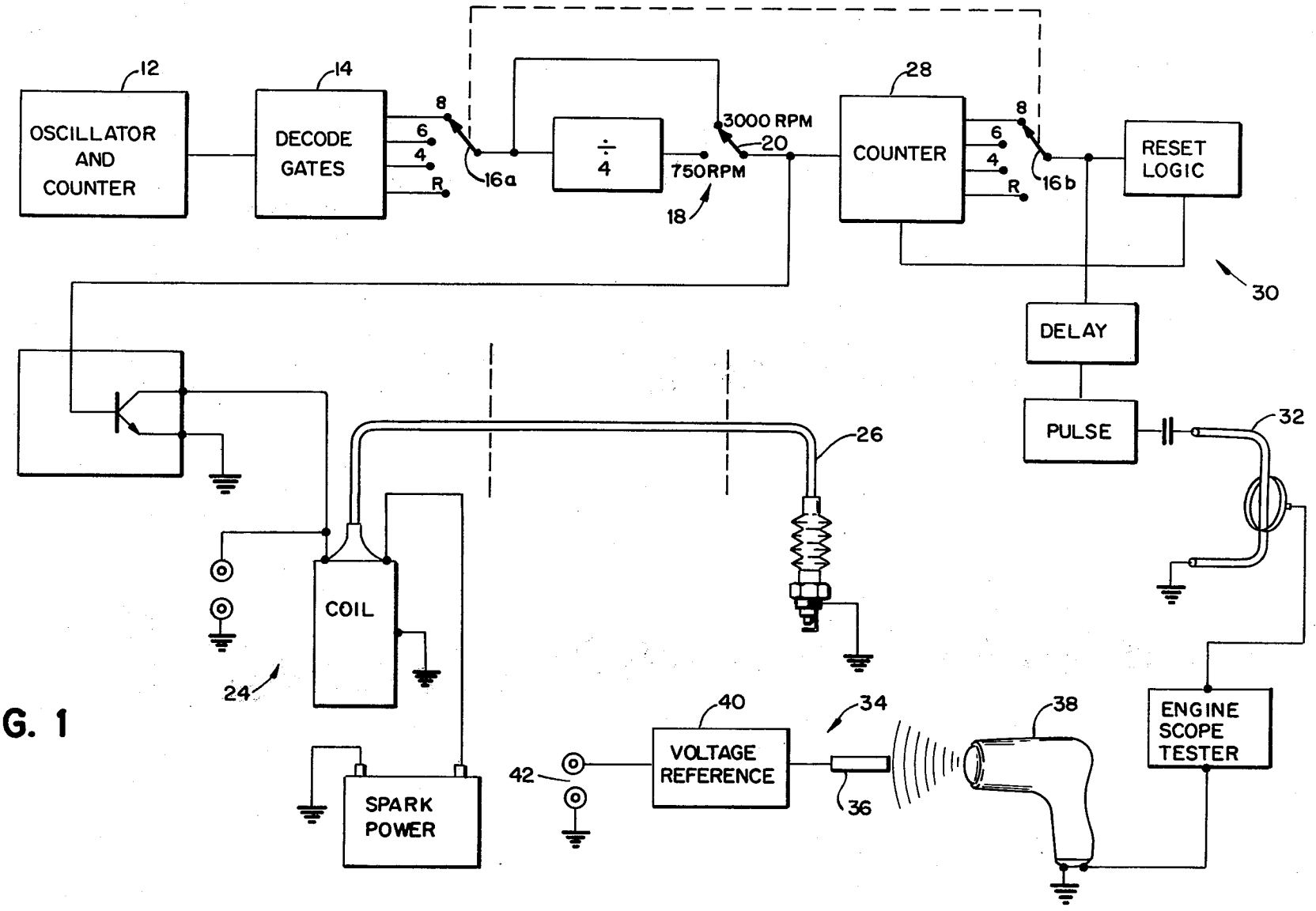
FIG. 1 is a block diagram of the preferred apparatus for practicing the method of the present invention as incorporated in a typical engine simulator.

FIG. 1 is, in general, a diagram of an engine simulator described in greater detail in U.S. patent application Ser. No. 707,903 entitled Engine Scope Tester Calibrator filed in the names of George I. Reeves and Michael J. Morales concurrently with this application. Briefly, the simulator generally indicated as 10 contains an oscillator and counter 12 which creates a series of pulses equal to the number of total spark plug firings in an engine of eight cylinders revolving at 3,000 r.p.m. A decode gate 14 is connected to the oscillator and counter 12 and provides outputs corresponding to the total spark plug firing rate at 3,000 r.p.m. of an eight cylinder, six cylinder, four cylinder and rotary engine. A switch **16*a* picks off the pulse rate for the engine desired to be simulated at any particular time. This pulse rate from switch 16*a* is then rescaled by appropriate apparatus such as that indicated generally as 18 wherein one path leads directly to one side of switch 20 allowing the selection of a 3,000 r.p.m. engine simulation, and the other side is first divided by four by circuit 22 before appearing at the other side of switch 20 to provide a 750 r.p.m. engine simulation capability. The output of switch 20 is fed to a conventional automobile transistorized ignition system generally indicated as 24. The automobile ignition system 24 responds to the pulses coming from switch 20 by creating a series of spark pulses in spark plug wire 26 at the same rate as all the spark plugs would be firing in an engine of the selected number of cylinders rotating at the selected r.p.m. A portion of spark plug wire 26 as indicated by the dotted lines is made available for sensing by the engine scope tester and appears as the loop of wire marked "COIL" in the apparatus of FIG. 2. The engine scope tester uses this signal as an input for vertical deflection of its CRT indicating the firing of all spark plugs in the simulated engine. The output of switch 20 is also connected to a counter 28 connected to switch 16*b* which is a tandem switch moving in positional synchronization with switch 16*a*. Counter 28 and switch 16*b* provide a pulsed output at switch 16*b* equal to the rate of firing of a single spark plug in an engine as selected. Additional circuitry generally indicated as 30 takes the output from switch 16*b* and causes a series of pulses in a second spark plug wire 32 also made available for sensing by the engine scope tester and designated as "SPARK PLUG" in the apparatus of FIG. 2. In the normal convention, spark plug wire 32 simulates the firing of the spark plug associated with cylinder No. 1. This signal is used as an input by the engine scope tester to trigger the tachometer, trigger the CRT sweep, and provide a timing pulse corresponding to the firing of cylinder No. 1 upon which timed sequences within the engine scope tester (such as the timing light offset circuit) can be based. To accomplish the method of the present invention according to the preferred embodiment, additional calibration apparatus generally indicated as 34 is provided. A light sensitive device such as photodiode 36 is positioned where the timing light 38 can be made to illuminate a portion of the photodiode 36 an amount sufficient to cause an electrical response. The output from photodiode 36 is connected to a voltage reference device 40 which is connected to amplify the signal from photodiode 36 and provide a signal capable of sensing by an engine scope tester at voltage reference output terminals 42**.

Figure 2:
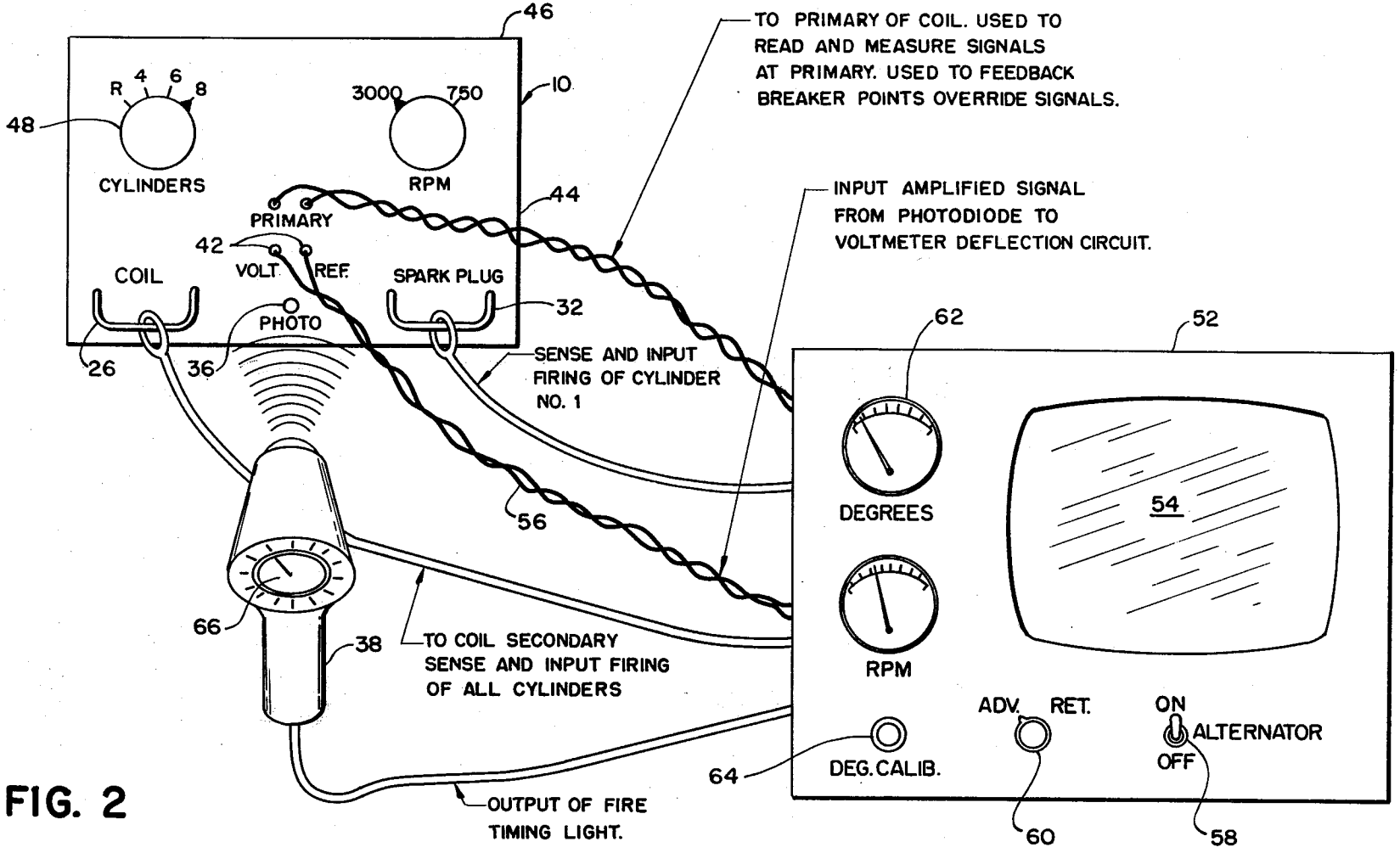
FIG. 2 is a pictorial representation of an engine simulator connected to an engine scope tester having a timing light when practicing the method of the present invention.

Referring now to FIG. 2, a simulator 10 containing calibration circuit of FIG. 1 has a housing 44 having front panel 46. Switch **16*a, b* appears on panel 46 as knob 48 being marked "CYLINDERS". Switch 20 appears on panel 46 as knob 50 labeled "R.P.M.". The photodiode 36 is mounted through panel 46 and is labeled "PHOTO". Voltage reference terminals 42 are mounted on panel 46 and are labeled "VOLT REF". A loop of spark plug wire 26 appears at the front of panel 46 as does a loop of spark plug wire 32 being labeled "COIL" and "SPARK PLUG", respectively. An engine scope tester 52 driving timing light 38 is operably connected to the simulator 10 and calibration apparatus 34 in an appropriate manner by the means provided. Provision must be made for displaying the output of voltage reference terminals 42 as a vertical pulse or spike on the CRT display 54 of engine scope tester 52. This is done by terminals 42 to the vertical deflection circuit of the CRT. One method found to be effective for this purpose is to connect voltage reference terminals 42 to the voltmeter leads 56 of engine scope tester 52. With the leads 56 thus connected, and ALTERNATOR switch 58 in the "ON" position, the voltage pulse can be displayed on the face of the CRT 54. In a typical engine scope tester 52 as wherein the present method and apparatus would be employed, a switch 60 is provided to select advance and retard mode (fire before TDC or after TDC), a meter 62 is provided to indicate the timing offset to timing light 38 in distributor degrees, a calibration knob 64 is provided to adjust the calibration of meter 62, and an offset adjust knob 66 is provided to adjust the amount of offset of the firing signal to timing light 38**.

Figure 3:
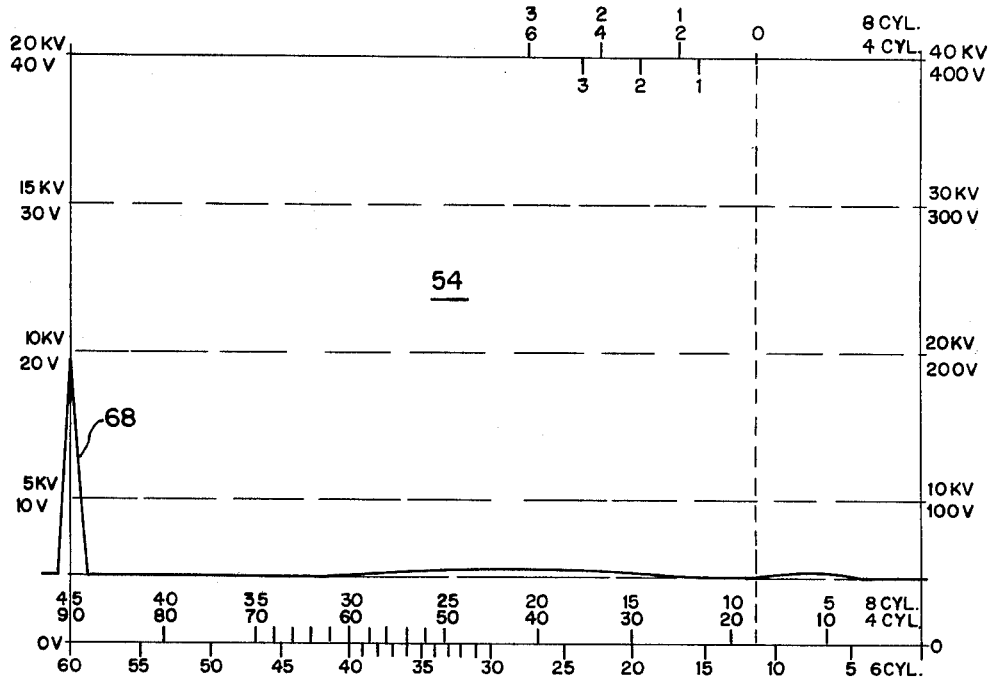
FIG. 3 is a representation of the display on an engine scope tester CRT with no offset to the timing light and with spark advance mode selected.

In an engine scope analyzer such as that of FIG. 2, the CRT display 54 contains calibrated markings such as that indicated on FIG. 3. The sweep across CRT 54 is adjusted automatically by the circuitry of engine scope analyzer 52 to correspond to the calibrated scale regardless of the number of cylinders being displayed. Note that engine scope tester 52 is not shown in complete detail, only those switches, meters, and connections of interest to the present invention are shown for ease and clarity. The method of calibration to be hereinafter described uses the calibrated CRT 54 of FIG. 3 which corresponds to the calibrations on a Beckman Model 595 Engine Scope Tester. The method, however, can be used with any engine scope tester of substantially the same capability by adapting the technique to the calibration scale of the particular instrument.

Figure 4:
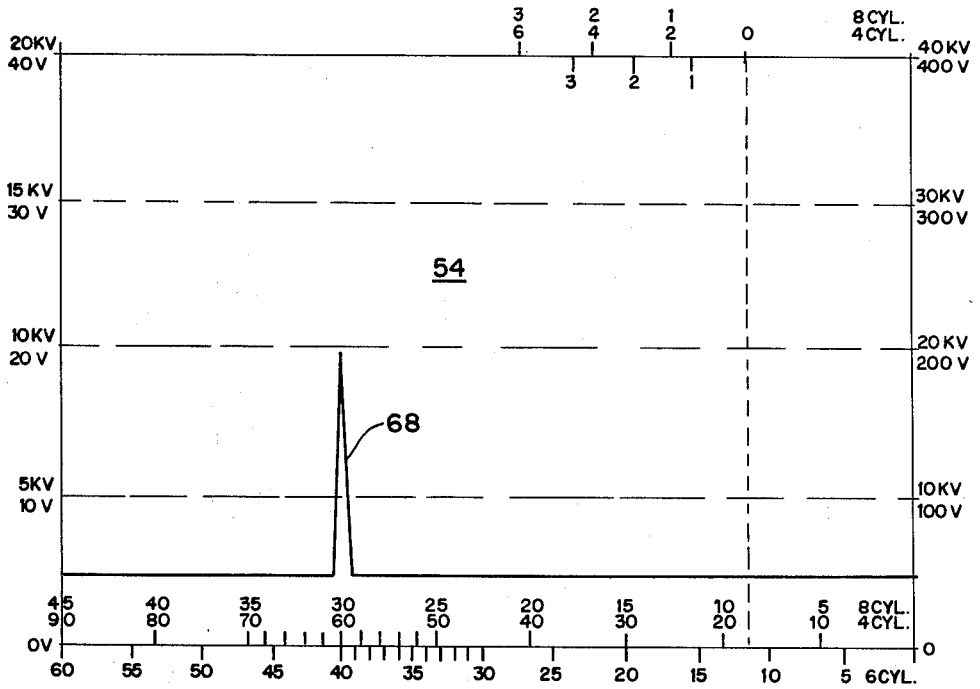
FIG. 4 is a representation of the display on an engine scope tester CRT when in the advance mode and with 15° of spark advance offset to the timing light.

Offset adjust knob 66 is first positioned in the OFF position to provide no offset between the actual time of No. 1 cylinder spark plug firing as indicated by the voltage pulse through spark plug wire 32 and the time of firing of timing light 38. At this point the degrees offset meter 62 should read zero. If not, and all other equipment is operating normally, the zero adjust (not shown) on meter 62 should be used to assure a true zero reading when no input is occurring to meter 62. With the offset adjust knob 66 set for no offset and the advance/retard mode switch 60 set in the advance position, a single spike should appear along the 45° line at the left side of the CRT 54 when the timing light 38 is positioned so as to shine on photodiode 36. (Assume an eight cylinder engine is being simulated as indicated by knob 48 so that the eight cylinder scale at the bottom of FIG. 3 is used.) If the offset adjust knob 66 is now rotated to create some offset, an offset will be caused in the firing of the timing light 38 corresponding to spark advance. As the knob 66 is rotated to cause more advance, spike 68 will move from the left side of CRT display 54 toward the right side as indicated in FIG. 4. In FIG. 4, spike 68 has moved from the 45° line to the 30° line (on the eight cylinder scale) indicating 15° of spark advance (45°−30°=15°). The CRT 54 is calibrated in distributor degrees. Since the spark has now been advanced by 15 distributor degrees, meter 62, if properly calibrated, should indicate twice that amount or 30 engine degrees. If the proper indication is not displayed on meter 52, an out-of-calibration condition is indicated and calibration knob 64 should be adjusted to calibrate meter 62 to indicate the proper 30° of engine offset to timing light 38.

Figure 5:
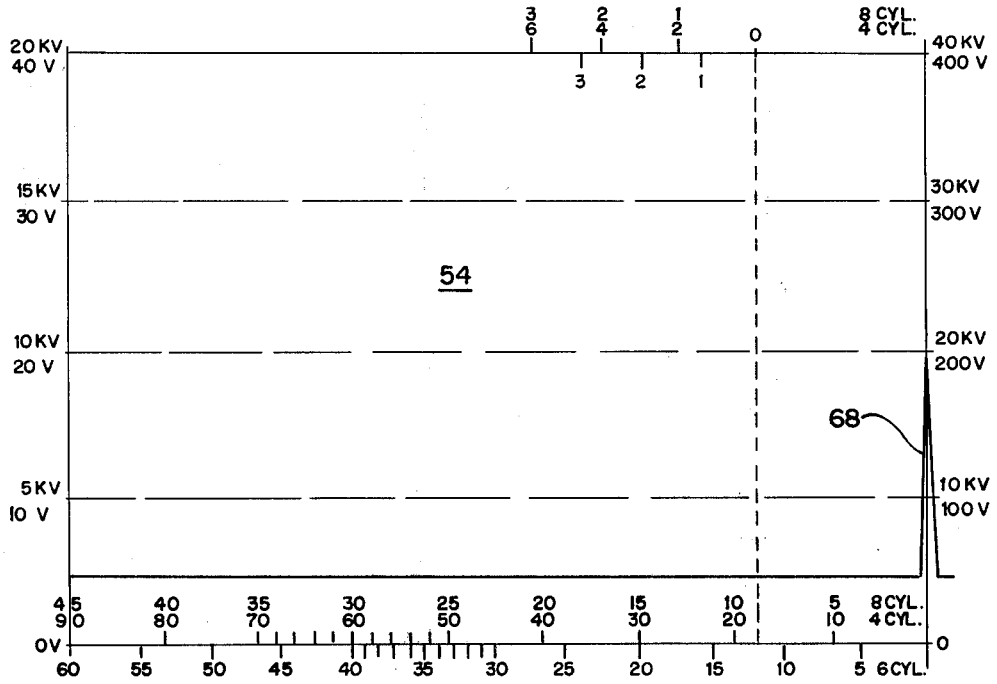
FIG. 5 is a representation of the display of an engine scope tester CRT in the spark retard mode and with no offset to the timing light.
Figure 6:
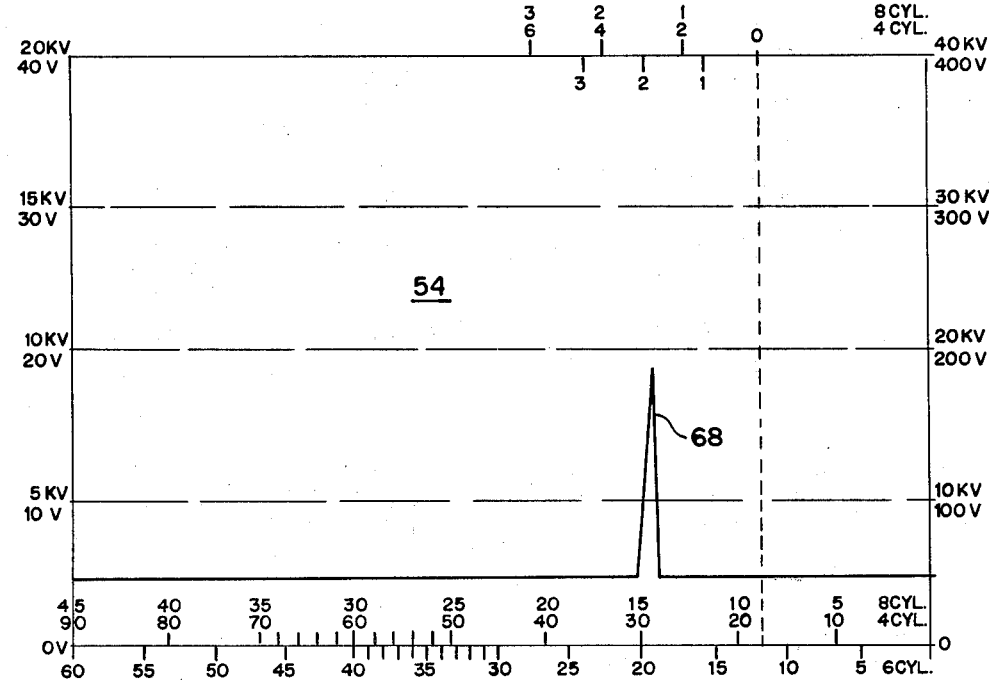
FIG. 6 is a representation of the display of an engine scope tester CRT in the retard mode with 15° retard to the timing light.

If the advance/retard mode switch 60 is turned to the retard position, spike 68 will appear along the 0° line at the right side of CRT 54 as shown in FIG. 5 when there is no offset to timing light 38 and will move to the left as offset adjust knob 66 is adjusted to create more spark retard offset to timing light 38. At 15° of spark retard, spike 68 would appear as shown on FIG. 6. In this position, spike 68 has moved from 0° to 15° indicating 15 distributor degrees of spark retard (15°−0°=15°). Thus, meter 62 should again indicate 30 engine degrees, being twice the number of distributor degrees. Once the degrees offset meter 62 has been calibrated by the above procedure, the engine scope tester 52 can be used to accurately adjust the distributor of an actual engine by setting the desired degrees offset into meter 62 with complete reliance that the relationship between the indicated degrees offset and the offset firing time of timing light 38 will be accurate.

Figure 7:
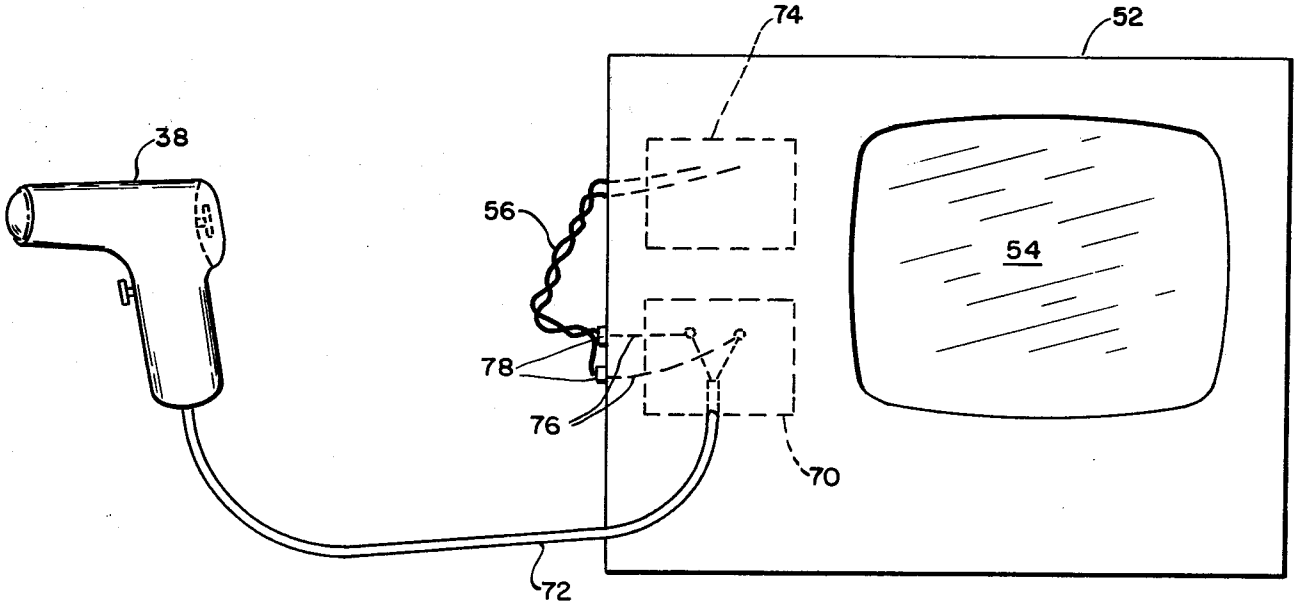
FIG. 7 is a partial block diagram of a modification to be made to an engine scope tester to accomplish the method of the present invention without the photoelectric detector.

An alternate approach to the method of the present invention is shown in FIG. 7. This, however, requires modification of the engine scope tester as shown. Engine scope tester 52 contains a timing light driver 70 which sends the fire signals to the timing light 38 through leads 72. Provision must be made for connecting leads 72 to a deflection circuit 74 of CRT 54. One technique as shown in FIG. 7 is to connect second leads 76 from leads 72 to terminals 78. Voltmeter leads 56 can then be connected to terminals 78 to accomplish the functions of photodiode 36, voltage reference device 40 and voltage reference terminals 42. The same connections could, of course, be wired permanently through switching means adapted to open and close the connection between voltmeter leads 56 and second leads 76 so that voltmeter leads 56 can be used for calibration or their normal function at the flip of a switch.

Having thus described my invention, I claim:

1. The method of calibrating a timing light associated with an internal combustion engine scope analyzer having a cathode ray tube with a sweep calibrated in units of engine rotation, an adjustable driver for firing the timing light offset in advance or retarded from top dead center of cylinder #1 of the engine, and a display indicating the amount of offset the timing light is being fired in advance or retarded, said method comprising the steps of:

a. detecting the fire signals from the driver to the timing light;
b. deflecting the sweep of the cathode ray tube to create a spike in response to each fire signal from the driver to the timing light;
c. adjusting the offset to the timing light to zero to create a spike at a first position;
d. adjusting the offset to the timing light to provide an offset to create a spike at a second position;
e. calculating the offset in units of engine rotation as a function of the change in position of the spike on the cathode ray tube from its first position to its second position; and,
f. adjusting the display to accurately reflect the calculated offset.

2. The method of claim 1 wherein said step of deflecting the sweep of the cathode ray tube to create a spike in response to each fire signal from the driver to the timing light is accomplished by connecting the fire signal from the driver to a deflection circuit in the cathode ray tube totally as an electrical signal.

3. The method of claim 1 wherein said step of deflecting the sweep of the cathode ray tube to create a spike in response to each fire signal from the driver to the timing light is accomplished by the steps of:

a. sensing the light pulses from the timing light in response to the fire signals by means of photoelectric apparatus;
b. generating an electrical pulse corresponding to each light pulse; and,
c. connecting the electrical pulses to a deflection circuit of the cathode ray tube.

4. The method of calibrating a timing light associated with an internal combustion engine scope analyzer having a cathode ray tube with a sweep calibrated in units of engine rotation, an adjustable driver for firing the timing light offset in advance or retarded from top dead center of cylinder #1 of the engine, and a display indicating the amount of offset the timing light is being fired in advance or retarded, said method comprising the steps of:

a. positioning the timing light to shine on a light responsive device;
b. amplifying any signal received from the light responsive device to provide a reference signal;
c. conducting the reference signal to a deflection circuit of the cathode ray tube whereby a spike will occur on the cathode ray tube when light from the timing light strikes the light responsive device;
d. adjusting the timing light offset of the driver to provide no offset to the timing light;
e. determining a first position of the spike on the cathode ray tube;
f. adjusting the timing light offset of the driver to provide an offset to the timing light;
g. determining a second position of the spike on the cathode ray tube;
h. calculating the actual amount of offset to the timing light in units of engine rotation as a function of the change in position of the spike from the first position to the second position on the calibrated scale of the cathode ray tube; and,
i. adjusting the timing light offset display to properly reflect the calculated actual amount of offset.

5. The method of claim 4 wherein the timing light offset display is indicating in degrees of distributor rotation and including the additional step of:

converting the calculated offset from engine degrees as displayed on the calibrated scale of the cathode ray tube to an offset in distributor degrees to be used for the step of adjusting the timing light offset display to properly reflect the actual amount of offset.

6. Apparatus for use in calibrating a timing light associated with a internal combustion engine scope analyzer having a cathode ray tube with a sweep calibrated in units of engine rotation, an adjustable driver for firing the timing light offset in advance or retarded from top dead center of cylinder #1 of the engine, and a display indicating the amount of offset the timing light is being fired in advance or retarded, said apparatus comprising:

a. means for detecting the fire signals from the driver to the timing light; and,
b. circuit means connecting said detecting means to a vertical deflection circuit of the cathode ray tube whereby each fire signal from the driver to the timing light will cause a corresponding vertical pulse from the cathode ray tube.

7. Apparatus as claimed in claim 6 wherein said detecting means includes:

means for detecting the light pulses from the timing light produced in response to the fire signals from the engine scope tester and for producing electrical signals in response thereto.

8. Apparatus as claimed in claim 7 wherein said detecting means includes a photoelectric device.

9. Apparatus as claimed in claim 8 and additionally including means for amplifying the electrical signal produced by said photoelectric device.

* * * * *